United States Patent [19]

Johansson

[11] Patent Number: 4,758,309

[45] Date of Patent: Jul. 19, 1988

[54] DEVICE FOR MOUNTING FABRICS IN PAPERMAKING MACHINES

[75] Inventor: Gunnar Johansson, Blomstermåla, Sweden

[73] Assignee: Nordiskafilt AB, Halmstad, Sweden

[21] Appl. No.: 749,539

[22] PCT Filed: Oct. 24, 1984

[86] PCT No.: PCT/SE84/00352

§ 371 Date: Jun. 20, 1985

§ 102(e) Date: Jun. 20, 1985

[87] PCT Pub. No.: WO85/01968

PCT Pub. Date: May 9, 1985

[30] Foreign Application Priority Data

Oct. 25, 1983 [SE] Sweden ..... 830549

[51] Int. Cl.[4] ..... D21F 1/10; D21F 7/08

[52] U.S. Cl. ..... 162/273; 162/274; 162/358; 162/DIG. 1; 139/383 A; 428/131; 428/138; 428/193; 428/280; 428/43

[58] Field of Search ..... 162/273, 274, 348, 353, 162/358, DIG. 1; 139/383 A, 425 A; 428/131, 136, 137, 43, 138, 280, 192, 193, 194

[56] References Cited

U.S. PATENT DOCUMENTS

| | | | |
|---|---|---|---|
| 2,207,609 | 7/1940 | Buchanan | 139/425 A |
| 3,523,867 | 8/1970 | MacBean | 139/425 A |
| 3,652,390 | 3/1972 | Peterson | 162/358 |
| 4,381,612 | 5/1983 | Shank | 34/116 |

FOREIGN PATENT DOCUMENTS

| | | | |
|---|---|---|---|
| 2028394 | 3/1980 | United Kingdom | 162/273 |

*Primary Examiner*—S. Leon Bashore
*Assistant Examiner*—Andrew J. Anderson
*Attorney, Agent, or Firm*—Kane, Dalsimer, Sullivan, Kurucz, et al.

[57] ABSTRACT

A device for mounting felts in papermaking machines, which device consists of a supplementary strip mounted along the lengthwise edge or edges of the felt. Spaced apart apertures are formed in the strip along the length of the felt. The apertures are shaped so as to be gripped manually or by means of special tools. Instead of a strip with apertures formed therein separate gripping means in the form of handle loops may be attached to the felt in spaced-apart relationship along the edge or edges of the felt.

6 Claims, 2 Drawing Sheets

FIG. 1
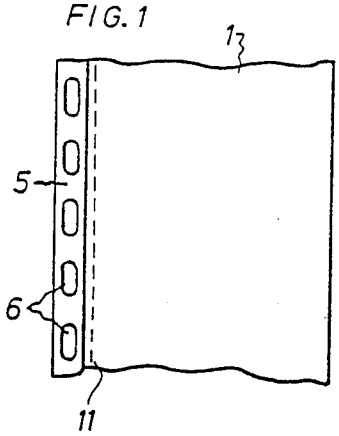
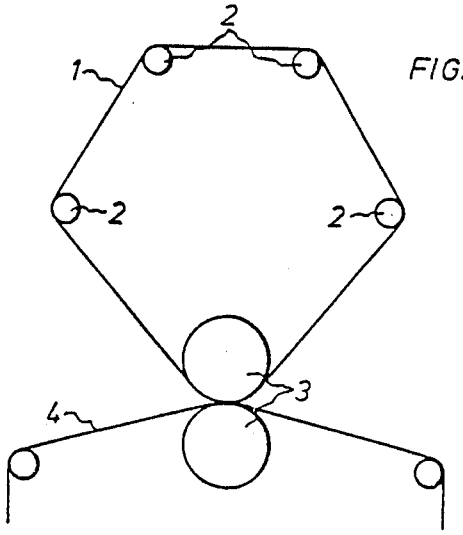
FIG. 2

DEVICE FOR MOUNTING FABRICS IN PAPERMAKING MACHINES

BACKGROUND OF THE INVENTION

The subject invention relates to a device for mounting felts in papermaking machines.

In the manufacture of paper the starting product is a fibre slurry suspended in water. The slurry is deposited in an even layer onto an endless wire fabric for dewatering of the fibrous layer which then is formed into a wet paper web. For further dewatering the paper web formed on the fabric is carried through presses in which the paper web is supported by press felts.

Generally, these felts consist of endless textile belts which when used in modern papermaking machines may have a width of 10 meters and a length of 10–30 meters. The felt may have a weight of 1–2 kg/m$^2$, which gives a total weight of several hundreds of kilos. The felts were out rapidly and usually need replacement after 5–30 days. To effect felt replacement it is necessary to move the press rollers apart and also to displace several other machine elements to allow removal of the worn felt and apply a fresh one in its place. The felt is rigid and hard, rather similar to wall-to-wall carpets, and it is placed in position entirely manually, since it is important that the felt surface is not damaged in order to avoid that fractural impressions or marks are produced in the paper web being dewatered with the aid of the felt.

The above-described work involved in placing the felt in position in the machine is a heavy and time-consuming one. To facilitate it, attempts have been made to provide the felt edges with attachable clamping tools but the latter easily mark the felt to a non-acceptable degree. Since clamping tools of this kind may separate from the felt they additionally constitute a non-acceptable safety hazard.

The purpose of the subject invention is to provide a device of the kind referred to for use in papermaker's felts to facilitate and shorten the work of mounting new felts on papermaking machines.

SUMMARY OF THE INVENTION

This purpose is obtained in accordance with the invention by means of a device designed for mounting felts on papermaking machines, which device is characterized therein that along one of its longitudinal edges or along both longitudinal edges the felt is provided with a supplementary strip having integral gripping means thereon or being equipped with separate gripping means which are adapted to be gripped by hand or by means of a tool.

The strip may be made integral with the felt itself or it may consist of a separate strip which is attached to the felts during the manufacture of the latter, either by being sewn onto the felt or secured thereto by means of an automatic coupling means, such as e.g. a zip fastener. Preferably, the strip is provided with apertures which are equally spaced apart along the length of the strip and form the gripping means proper. These apertures may be made by punching and may be comparatively large to allow insertion and engagement with a hand or comparatively small to allow special tools to be secured therein.

Alternatively, the separate gripping means may be in the form of handle loops which are sewn onto the felt at intervals along the felt edge or edges after the manufacture proper of the felt.

The gripping means with its associated strip, if any, may be designed to remain attached to the felt without affecting the function of the latter during operation in the papermaking machine. Alternatively, the gripping means may be designed for removal once the felt is in position in the machine. In order to facilitate removal some form of perforation may be provided between the strip or the separate gripping means respectively, and the felts. Likewise, it is possible, during the weaving of the felt to provide the latter with a special weakening line or marker. Once the felt is in position in the papermaking machine the parts projecting beyond the felt itself may easily be severed to provide a clear-cut felt edge.

It should be understood therefore that the subject invention provides not only for quicker felt exchanges but also for safer ones.

BRIEF DESCRIPTION OF THE DRAWINGS

The invention will be described in closer detail in the following with reference to the accompanying drawings, wherein FIG. 1 shows schematically one preferred embodiment of the invention in which a perforating line is provided to facilitate removal of the gripping means, FIG. 2 illustrates a possible arrangement of a felt on a papermaking machine.

DETAILED DESCRIPTION OF A PREFERRED EMBODIMENT

Figure 3:
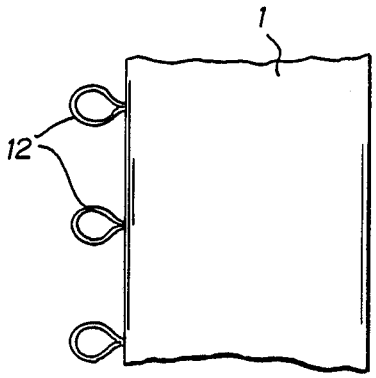
FIG. 3 is a view similar to FIG. 1 showing handle loops.

FIG. 2 illustrates an endless felt 1 which is carried around a plurality of conducting rollers 2 and through the press nip between two press rollers 3. A paper web 4 to be dewatered, is likewise carried through this press nip.

To replace a felt of the kind shown in FIG. 2 between 20 and 40 manpower hours may be required and a papermaking machine may comprise between three and five such felts. It is obvious, therefore, that considerable savings may be made by reducing the length of time required to mount the felt in the machine.

The part of the felt 1 illustrated in FIG. 1 is provided along one lengthwise edge of the felt with an extra strip 5 in which apertures 6 are formed. These apertures may be designed so as to make them suitable to be gripped by hand or alternatively, by a tool. Perforating line 11 is provided to facilitate removal of the gripping means.

Figure 4:
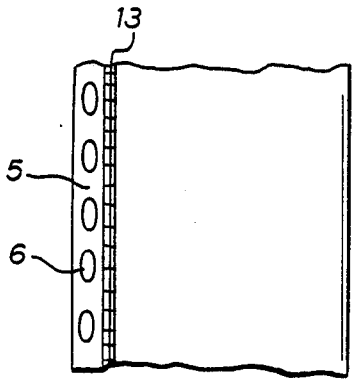
FIG. 4 is a view similar to FIG. 1 in which a weakened woven zone is provided to facilitate removal of the gripping means.

FIG. 3 is provided to illustrate the embodiment of the invention wherein handle loops 12 are provided. FIG. 4 is a view similar to FIG. 1 but in which an alternate means for removal of the gripping means is provided. In the embodiment of FIG. 4, the perforating line of the FIG. 1 embodiment has been replaced by a weakened woven zone 13.

The artisan in the field readily understands that several modifications are possible to the embodiment shown without departing from the scope of the invention as the latter is defined in the appended claims.

What I claim is:

1. An improved device for installation of felts in papermaking machines, the improvement comprising a supplementary strip provided in said felt along one or both longitudinally extending felt edges and gripping means in said supplementary strip, said gripping means adapted to be gripped by hand or by means of a tool.

2. An improved device as claimed in claim 1, wherein said supplementary strip is an integral part of said felt itself.

3. An improved device as claimed in claim 2, comprising a weakened zone made in said felt during the weaving thereof, said weakened zone forming the border between said strip and said felt interiorly of said strip.

4. An improved device as claimed in claim 1, wherein said supplementary strip is a separate strip, said strip being attached to said felt during the manufacture of the latter.

5. An improved device as claimed in claim 1, wherein apertures are formed in said supplementary strip, said apertures spaced equally apart along the length of said felt, said apertures forming said gripping means.

6. An improved device as claimed in claim 1, comprising a perforating line made between said strip and said felt.

* * * * *